US011804353B1

(12) United States Patent
Silvederio et al.

(10) Patent No.: US 11,804,353 B1
(45) Date of Patent: Oct. 31, 2023

(54) FUSE BODY WITH NOTCHED ENDS

(71) Applicant: Littelfuse, Inc., Chicago, IL (US)

(72) Inventors: Edwin Nery Silvederio, Batangas (PH); Fernando Isip Arce, Jr., Paranaque Cite (PH); Francisco Rivera De Guia, Jr., Laguna (PH); Mark Joseph Lian, Batangas (PH)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 17/873,407

(22) Filed: Jul. 26, 2022

(51) Int. Cl.

| | |
|---|---|
| ***H01H 85/175*** | (2006.01) |
| ***H01H 85/165*** | (2006.01) |
| ***H01H 69/02*** | (2006.01) |
| ***H01H 85/055*** | (2006.01) |

(52) U.S. Cl.
CPC ..... *H01H 85/165* (2013.01); *H01H 69/02* (2013.01); *H01H 85/055* (2013.01); *H01H 85/175* (2013.01)

(58) Field of Classification Search
CPC .... H01H 69/02; H01H 85/055; H01H 85/165; H01H 85/17; H01H 85/175; H01H 85/1755
See application file for complete search history.

(56) References Cited

U.S. PATENT DOCUMENTS

| | | | | |
|---|---|---|---|---|
| 3,721,936 | A * | 3/1973 | Belcher | H01H 85/303 337/241 |
| 4,158,187 | A * | 6/1979 | Perreault | H01H 85/157 337/248 |
| 4,920,327 | A * | 4/1990 | Arikawa | H01H 85/0411 337/252 |
| 5,214,406 | A * | 5/1993 | Reese | H01H 85/143 337/252 |
| 5,642,090 | A * | 6/1997 | Arikawa | H01H 85/157 337/186 |
| 8,368,502 | B2 * | 2/2013 | Washizaki | H01H 85/1755 337/296 |
| 2009/0072943 | A1 * | 3/2009 | Aberin | H01H 85/20 337/186 |
| 2017/0372862 | A1 * | 12/2017 | Bruan | H01H 85/175 |

* cited by examiner

*Primary Examiner* — Jacob R Crum
(74) *Attorney, Agent, or Firm* — KDW Firm PLLC

(57) ABSTRACT

A fuse including a fuse body having first and second end faces at opposing first and second longitudinal ends thereof, each of the first and second end faces having at least one notch formed therein, a fusible element extending through the fuse body and having a first end bent over the first end face and disposed within the at least one notch in the first end face and a second end bent over the second end face and disposed within the at least one notch in the second end face, and a first endcap disposed on the first longitudinal end of the fuse body and a second endcap disposed on the second longitudinal end of the fuse body, wherein the first and second endcaps flatly abut the first and second end faces without interference from the fusible element.

14 Claims, 4 Drawing Sheets

FUSE BODY WITH NOTCHED ENDS

FIELD OF THE DISCLOSURE

The present disclosure relates generally to the field of circuit protection devices and relates more particularly to a surface mount fuse having a fuse body adapted to facilitate coplanarity of the fuse's end caps to improve installation of the fuse on a circuit board.

FIELD OF THE DISCLOSURE

Fuses are commonly used as overcurrent protection devices and are typically installed between a source of electrical power and a component in an electrical circuit that is to be protected. One type of fuse, commonly referred to as a "surface mount fuse," is adapted to be mounted directly on a printed circuit board (PCB). A cross-sectional view illustrating a conventional, prior art surface mount fuse 10 (hereinafter "the fuse 10") is shown in FIG. 1A. The fuse 10 includes a hollow, electrically insulating fuse body 12 having the shape of a rectangular cylinder. A fusible element 14 extends diagonally through the interior of the fuse body 12 and is bent or wrapped around the longitudinal end faces of the fuse body 12. Electrically conductive first and second endcaps 16, 18 cover the opposing longitudinal ends of the fuse body 12 and engage the fusible element 14, establishing an electrical pathway therewith. Upon the occurrence of a fault condition, such as an overcurrent condition, the fusible element 14 melts or otherwise separates to interrupt the flow of electrical current through the fuse 10, thus protecting connected electrical components.

A shortcoming associated with traditional surface mount fuses of the type described above is that the orientation of the endcaps can be skewed relative to the fuse body due to interference with protruding portions of the fusible element. This is illustrated in the detailed cross-sectional view of the above-described fuse 10 shown in FIG. 1B. Specifically, the portion of the fusible element 14 that extends over the end face of the fuse body 12 causes the left side of the endcap 16 (as oriented in FIG. 1B) to sit higher than the right side of the endcap 16. Skewed thusly, the endcaps 16, 18 will be out of parallel with each other and out of parallel with a PCB to which they are mounted (e.g., via solder), resulting in suboptimal affixation and electrical connection to the PCB.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

A fuse in accordance with an exemplary embodiment of the present disclosure includes a tubular fuse body having first and second end faces at opposing first and second longitudinal ends thereof, each of the first and second end faces having at least one notch formed therein, a fusible element extending through the fuse body, the fusible element having a first end bent over the first end face and disposed within the at least one notch in the first end face and a second end bent over the second end face and disposed within the at least one notch in the second end face, and a first endcap disposed on the first longitudinal end of the fuse body and a second endcap disposed on the second longitudinal end of the fuse body, the first and second endcaps being in electrical communication with the fusible element, wherein the first endcap flatly abuts the first end face without interference from the fusible element, and wherein the second endcap flatly abuts the second end face without interference from the fusible element.

A method of manufacturing a fuse in accordance with an exemplary embodiment of the present disclosure includes providing a tubular fuse body having first and second end faces at opposing first and second longitudinal ends thereof, each of the first and second end faces having at least one notch formed therein, disposing a fusible element within the fuse body, bending a first end of the fusible element over the first end face with the first end of the fusible element disposed within the at least one notch in the first end face and bending a second end of the fusible element over the second end face with the second end of the fusible element disposed within the at least one notch in the second end face, fastening a first endcap on the first longitudinal end of the fuse body in electrical communication with the fusible element and fastening a second endcap on the second longitudinal end of the fuse body in electrical communication with the fusible element.

DETAILED DESCRIPTION

Figure 1A:
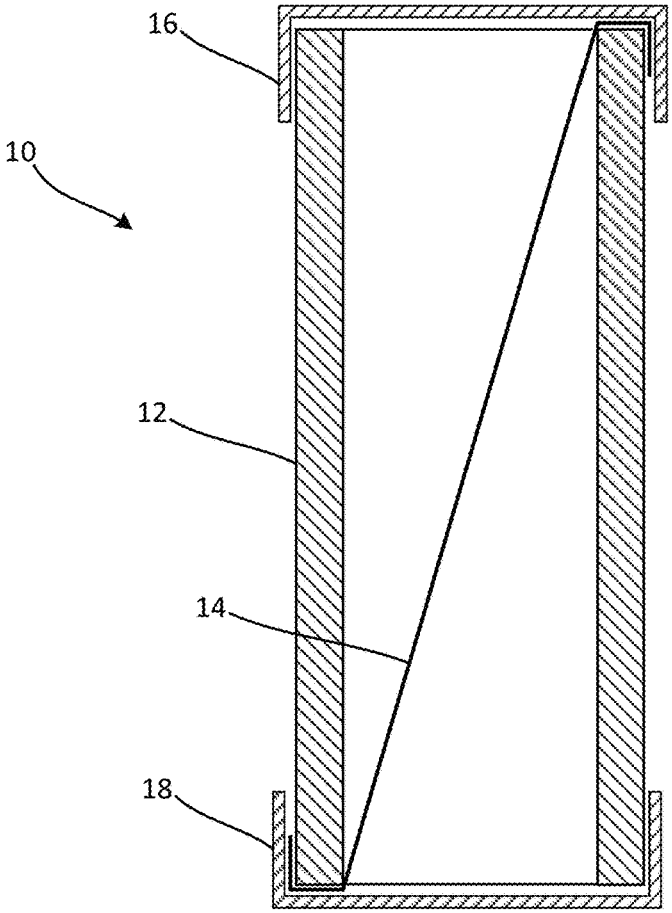
Fig. 1A (Prior art)
FIG. 1A is a cross-sectional view illustrating a surface mount fuse in accordance with the prior art.

Embodiments of a surface mount fuse and a method for manufacturing the same in accordance with the present disclosure will now be described more fully with reference to the accompanying drawings, in which preferred embodiments of the present disclosure are presented. The surface mount fuse and the accompanying method of the present disclosure may, however, be embodied in many different forms and should not be construed as being limited to the embodiments set forth herein. Rather, these embodiments are provided so that this disclosure will be thorough and complete, and will fully convey the scope of the surface mount fuse and the accompanying method to those skilled in the art. In the drawings, like numbers refer to like elements throughout unless otherwise noted.

Figure 2B:
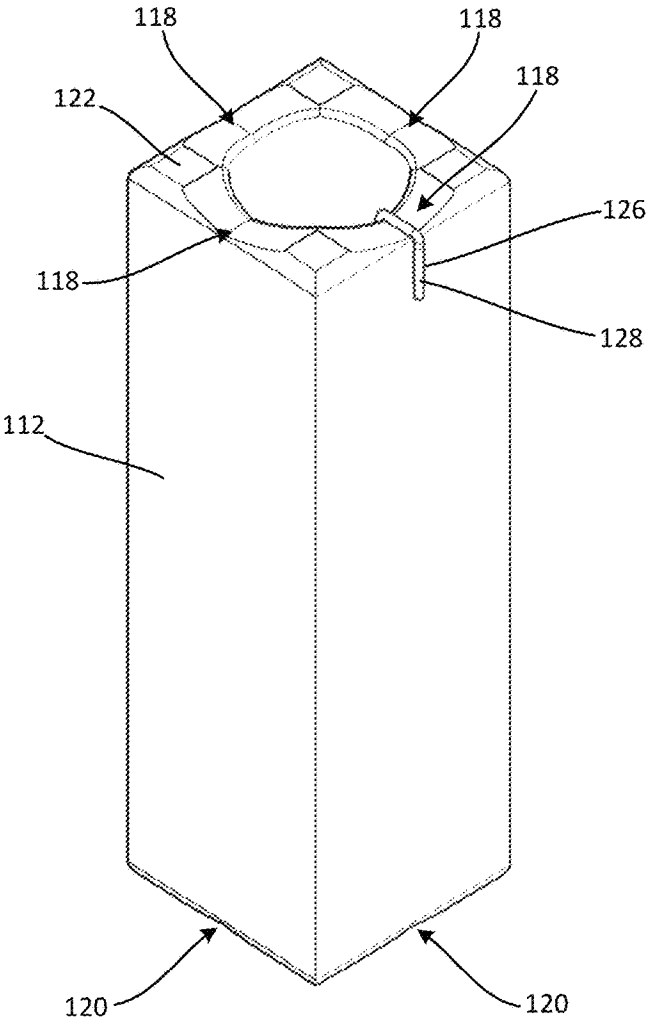
FIG. 2B is a perspective view illustrating a fuse body and fusible element of the surface mount fuse shown in FIG. 2A
Figure 2A:
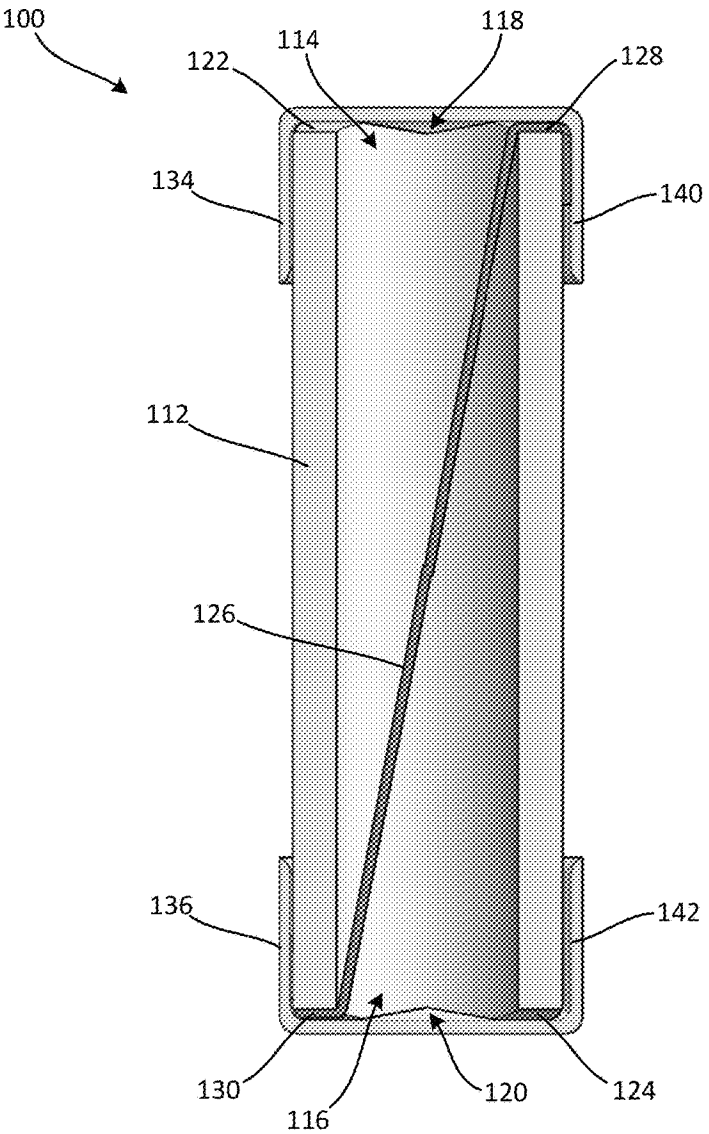
FIG. 2A is a cross-sectional view illustrating an exemplary surface mount fuse in accordance with the present disclosure.

Referring to FIG. 2A, a cross-sectional view of a surface mount fuse 100 (hereinafter "the fuse 100") in accordance with an exemplary embodiment of the present disclosure is shown. For the sake of convenience and clarity, terms such as "top," "bottom," "above," "below," "lateral," "longitudinal," etc. may be used herein to describe the relative placement and orientation of various components of the fuse 100, each with respect to the geometry and orientation of the fuse 100 as it appears in FIG. 2A. Said terminology will include the words specifically mentioned, derivatives thereof, and words of similar import.

The fuse 100 may include an elongated, tubular fuse body 112 having open ends 114, 116. The fuse body 112 may be formed of an electrically insulating and preferably heat resistant material, including, but not limited to, ceramic or glass. The fuse body 112 may have the shape of a square tube (as shown in FIG. 2B), but this is not critical. Alternative embodiments of the fuse 100 may have a fuse body with the shape of a round tube, an oval tube, a triangular tube, etc.

Figure 3B:
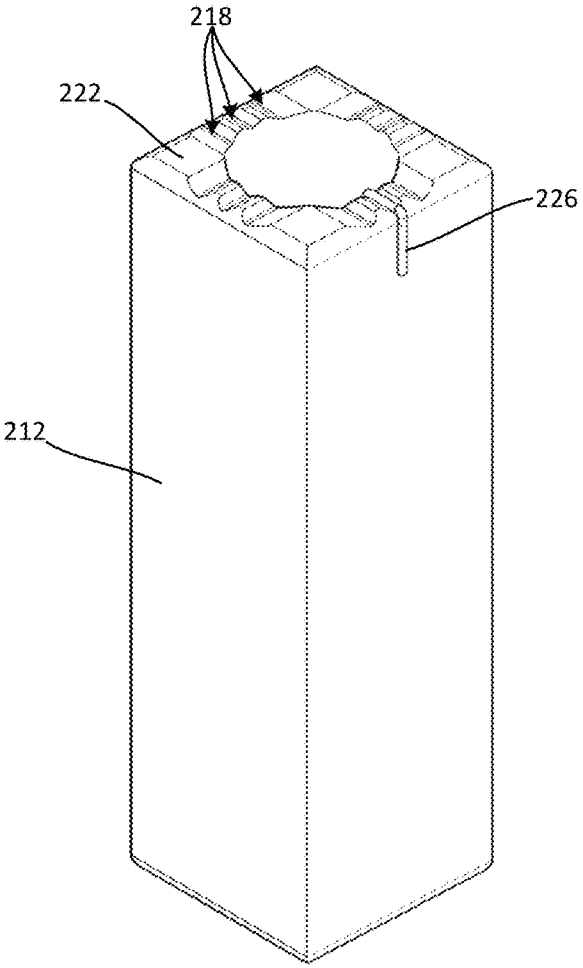
FIG. 3B is a perspective view illustrating a fuse body and fusible element of the surface mount fuse shown in FIG. 3A.
Figure 3A:
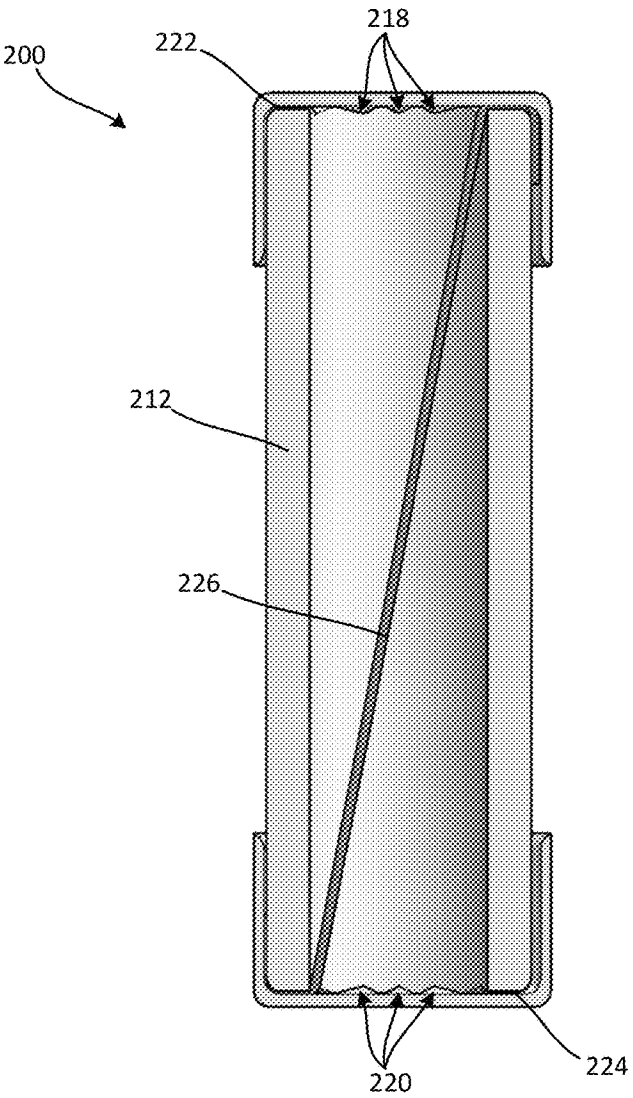
FIG. 3A is a cross-sectional view illustrating another exemplary surface mount fuse in accordance with the present disclosure.

As best shown in FIG. 2B, the fuse body 112 may have notches 118, 120 formed in opposing first and second end faces 122, 124 thereof, respectively. For example, each of the first and second end faces 122, 124 may have a single notch formed in each of its sides, totaling 4 notches 118, 120 in each of the first and second end faces 122, 124 (only 2 of the notches 120 in the end face 124 are visible in FIG. 2B). The present disclosure is not limited in this regard. In an alternative embodiment of the present disclosure, each of the first and second end faces 122, 124 may have a single notch formed in only one of its sides, with the notch in the first end face 122 located on an opposite lateral side of the fuse body 112 relative to the notch formed in the second end face 124 to facilitate diagonal routing of a fusible element as further described below. In yet another alternative embodiment of the present disclosure, each of the first and second end faces 122, 124 may have a plurality of notches formed in each of its sides as shown in FIGS. 3A and 3B and as further described below.

The notches 118, 120 may have a size and a shape adapted to accommodate an entirety of a diameter of a fusible element disposed in the notches as further described below. In various non-limiting examples, the notches may have a depth in a range of 0.05 to 0.20 millimeters. The present disclosure is not limited in this regard. As shown in FIG. 2B, the notches 118, 120 may be rounded. This is not intended to be limiting. In various alternative embodiments, the notches 118, 120 may be V-shaped or square-shaped, for example.

Referring again to FIG. 2A, the fuse 100 may include a fusible element 126 that extends diagonally through the hollow interior of the fuse body 112, from one lateral side of the fuse body 112 to an opposite lateral side of the fuse body 112. First and second ends 128, 130 of the fusible element 126 may be bent or wrapped over the first and second end faces 122, 124 of the fuse body 112, with the first end 128 of the fusible element 126 seated in a notch 118 on a first lateral side of the fuse body 112 (best shown in FIG. 2B) and the second end 130 of the fusible element 126 seated in a notch 120 on a second lateral side of the fuse body 112 opposite the first side. The fusible element 126 may be formed of an electrically conductive material, including, but not limited to, tin or copper, and may be configured to melt and separate upon the occurrence of a predetermined fault condition such as an overcurrent condition in which an amount of current exceeding a predefined, maximum current flows through the fusible element 126. The fusible element 126 may be any type of fusible element suitable for a desired application, including, but not limited to, a fuse wire, a corrugated strip, a fuse wire wound about an insulating core, etc.

The fuse 100 may further include electrically conductive first and second endcaps 134, 136 disposed on the longitudinal ends of the fuse body 112 in electrical communication with the fusible element 126. For example, the first and second endcaps 134, 136 may be connected to the fuse body 112 and the fusible element 126 by solder or electrically conductive adhesive (not shown). The present disclosure is not limited in this regard. The first and second endcaps 134, 136 may be formed of an electrically conductive material, including, but not limited to, copper or one of its alloys, and may be plated with nickel or other conductive, corrosion resistant coatings. Thus, the first and second endcaps 134, 136 may facilitate electrical connection of the fuse 100 within a circuit. For example, the first and second endcaps 134, 136 can be soldered to respective terminals on a printed circuit board (PCB).

Owing to the above-described configuration of the fuse body 112 and the fusible element 126, with the first and second ends 128, 130 of the fusible element 126 entirely seated within the notches 118, 120 in the end faces 122, 124 of the fuse body 112, the fuse 100 of the present disclosure may provide distinct advantages over conventional surface mount fuses. For example, when the first and second endcaps 134, 136 are mounted on the ends of the fuse body 112, they may flatly abut the first and second end faces 122, 124 of the fuse body 112 without interference from the fusible element 126 (i.e., without the first and second endcaps 134, 136 directly engaging, and being tilted/skewed by, the first and second ends 128, 130 of the fusible element 126 as in the prior art fuse shown in FIG. 1B). Thus, a sidewall 140 of the first endcap 134 may be parallel and coplanar (or substantially coplanar) with a sidewall 142 of the second endcap 136. The sidewalls 140, 142 may therefore both be parallel and coplanar (or substantially coplanar) with the surface of a PCB (not shown) to which the fuse 100 is mounted, thus facilitating optimal affixation and electrical connection to the PCB. As a further advantage, the notches 118, 120 may facilitate convenient and expeditious centering/positioning of the fusible element 126 on the first and second end faces 122, 124 of the fuse body 112.

Referring to FIG. 3A, a cross-sectional view illustrating a surface mount fuse 200 (hereinafter "the fuse 200") in accordance with another exemplary embodiment of the present disclosure is shown. A perspective view illustrating a fuse body 212 of the fuse 200 is shown in FIG. 3B. The fuse 200 may be substantially similar to the fuse 100 described above and shown in FIGS. 2A and 2B, except that the fuse body 212 may include a plurality of notches 218, 220 formed in each side of each of the end faces 222, 224 of the fuse body 212. The notches 218, 220 may have different sizes and/or shapes for allowing the fuse body 212 to accommodate fusible elements of different cross-sectional sizes and/or shapes as may be appropriate for a particular application. For example, a first of the notches 218 may be relatively shallow and/or narrow, while an adjacent one of the notches 218 may be relatively wide and/or deep. The present disclosure is not limited in this regard. Moreover, the various notches 218, 220 may facilitate positioning/securing of the fusible element 226 at desired lateral locations along the sides of the end faces 222, 224 of the fuse body 212 (i.e., instead of being laterally centered on the sides of the end faces 222, 224 of the fuse body 212 as in the fuse 100).

Figure 4:
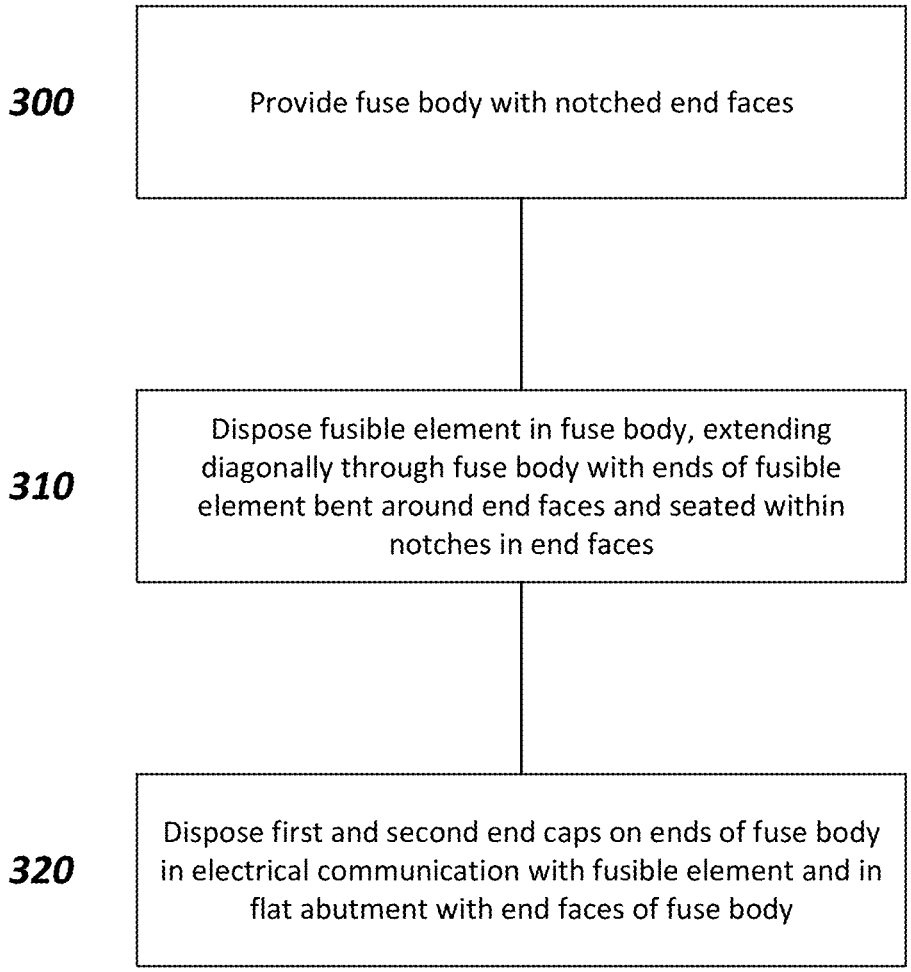
FIG. 4 is flow diagram illustrating an exemplary method of manufacturing a surface mount fuse in accordance with the present disclosure.

Referring to FIG. 4, a flow diagram illustrating an exemplary method for manufacturing the above-described fuses 100, 200 in accordance with the present disclosure is shown. The method will now be described in conjunction with the illustrations of the fuses 100, 200 shown in FIGS. 2A-3B.

At step 300 of the exemplary method, the tubular fuse body 112 having open ends 114, 116 may be provided. The fuse body 112 may be formed of an electrically insulating and preferably heat resistant material, including, but not limited to, ceramic or glass. The fuse body 112 may have notches 118, 120 formed in opposing first and second end faces 122, 124 thereof, respectively. Referring to the embodiment of the fuse 100 shown in FIGS. 2A and 2B, each of the first and second end faces 122, 124 of the fuse body 112 may have a single notch 118, 120 formed in each of its sides. In an alternative embodiment, each of the first and second end faces 122, 124 may have a single notch formed in only one of its sides. In yet another alternative embodiment shown in FIGS. 3A and 3B, each of the first and second end faces 222, 224 of the fuse body 212 may have a plurality of notches 218, 220 formed in each of its sides. The notches 218, 220 may have different sizes and/or shapes to accommodate fusible elements having various cross-sectional sizes and/or shapes.

At step 310 of the exemplary method, a fusible element 126 may be disposed within the fuse body 112. The fusible element 126 may extend diagonally through the hollow interior of the fuse body 112, from one lateral side of the fuse body 112 to an opposite lateral side of the fuse body 112, and the first and second ends 128, 130 of the fusible element 126 may be bent or wrapped over the first and second end faces 122, 124 of the fuse body 112, with the first end 128 of the fusible element 126 seated in a notch 118 on a first lateral side of the fuse body 112 (best shown in FIG. 2B) and the second end 130 of the fusible element 126 seated in a notch 120 on a second lateral side of the fuse body 112 opposite the first side. The fusible element 126 may be formed of an electrically conductive material, including, but not limited to, tin or copper, and may be configured to melt and separate upon the occurrence of a predetermined fault condition such as an overcurrent condition in which an amount of current exceeding a predefined, maximum current flows through the fusible element 126. The fusible element 126 may be any type of fusible element suitable for a desired application, including, but not limited to, a fuse wire, a corrugated strip, a fuse wire wound about an insulating core, etc.

At step 320 of the exemplary method, the electrically conductive first and second endcaps 134, 136 may disposed on the longitudinal ends of the fuse body 112 in electrical communication with the fusible element 126. For example, the first and second endcaps 134, 136 may be connected to the fuse body 112 and the fusible element 126 by solder or electrically conductive adhesive (not shown). The present disclosure is not limited in this regard. The first and second endcaps 134, 136 may be formed of an electrically conductive material, including, but not limited to, copper or one of its alloys, and may be plated with nickel or other conductive, corrosion resistant coatings.

Figure 1B:
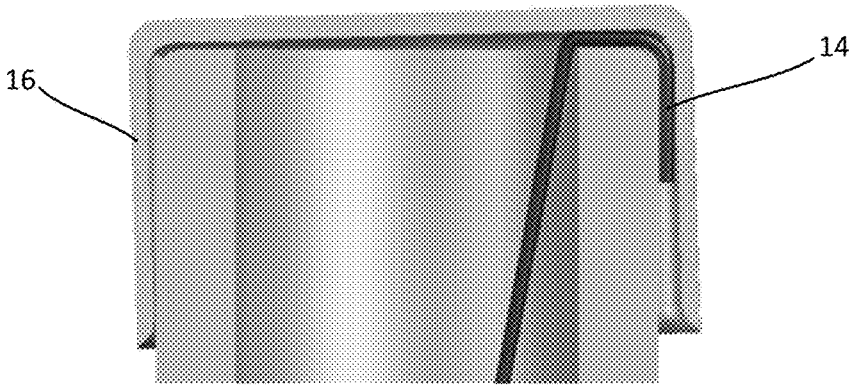
Fig. 1B (Prior art)
FIG. 1B is a detailed cross-sectional view illustrating an end of the surface mount fuse shown in FIG. 1A.

Since the first and second ends 128, 130 of the fusible element 126 are seated within the notches 118, 120, the first and second endcaps 134, 136 may flatly abut the first and second end faces 122, 124 of the fuse body 112 without interference from the fusible element 126 (i.e., without the first and second endcaps 134, 136 directly engaging, and being tilted/skewed by, the first and second ends 128, 130 of the fusible element 126 as in the prior art fuse shown in FIG. 1B). Thus, a sidewall 140 of the first endcap 134 may be coplanar (or substantially coplanar) with a sidewall 142 of the second endcap 136. The sidewalls 140, 142 may therefore both be coplanar (or substantially coplanar) with the surface of a PCB (not shown) to which the fuse 100 is mounted, thus facilitating optimal affixation and electrical connection to the PCB. As a further advantage, the notches 118, 120 may facilitate convenient and expeditious centering/positioning of the fusible element 126 on the first and second end faces 122, 124 of the fuse body 112.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A fuse comprising:

a tubular fuse body having a hollow interior and first and second end faces at opposing first and second longitudinal ends thereof, each of the first and second end faces having a plurality of notches formed therein extending from the hollow interior to a sidewall of the fuse body, the plurality of notches having different sizes;

a fusible element extending through the fuse body, the fusible element having a first end bent over the first end face and disposed within one of the plurality of notches in the first end face and a second end bent over the second end face and disposed within one of the plurality of notches in the second end face; and a first endcap disposed on the first longitudinal end of the fuse body and a second endcap disposed on the second longitudinal end of the fuse body, the first and second endcaps being in electrical communication with the fusible element.

2. The fuse of claim 1, wherein the fusible element extends diagonally through the fuse body.

3. The fuse of claim 1, wherein the fuse body has the shape of a square tube with four sides, wherein the plurality of notches in the first end face are located on a first lateral side of the fuse body, and wherein the plurality of notches in the second end face are located on a second lateral side of the fuse body opposite the first lateral side.

4. The fuse of claim 1, wherein the fuse body has the shape of a square tube with four sides, wherein the first end face has a plurality of notches formed in each side thereof and wherein the second end face has a plurality of notches formed in each side thereof.

5. The fuse of claim 1, the notches in the first end face having different shapes.

6. The fuse of claim 1, wherein the first endcap flatly abuts the first end face without interference from the fusible element, and wherein the second endcap flatly abuts the second end face without interference from the fusible element.

7. The fuse of claim 1, wherein a sidewall of the first endcap is parallel with a sidewall of the second endcap.

8. A method of manufacturing a fuse, the method comprising:

providing a tubular fuse body having a hollow interior and first and second end faces at opposing first and second longitudinal ends thereof, each of the first and second end faces having a plurality of notches formed therein extending from the hollow interior to a sidewall of the fuse body, the plurality of notches having different sizes;

disposing a fusible element within the fuse body;

bending a first end of the fusible element over the first end face with the first end of the fusible element disposed within one of the plurality of notches in the first end face and bending a second end of the fusible element over the second end face with the second end of the fusible element disposed within one of the plurality of notches in the second end face; and fastening a first endcap on the first longitudinal end of the fuse body in electrical communication with the fusible element and fastening a second endcap on the second longitudinal end of the fuse body in electrical communication with the fusible element.

9. The method of claim 8, wherein the fusible element extends diagonally through the fuse body.

10. The method of claim 8, wherein the fuse body has the shape of a square tube with four sides, wherein the plurality of notches in the first end face are located on a first lateral side of the fuse body, and wherein the plurality of notches in the second end face are located on a second lateral side of the fuse body opposite the first lateral side.

11. The method of claim 8, wherein the fuse body has the shape of a square tube with four sides, wherein the first end face has a plurality of notches formed in each side thereof and wherein the second end face has a plurality of notches formed in each side thereof.

12. The method of claim 8, the notches in the first end face having different shapes.

13. The method of claim 8, wherein the first endcap flatly abuts the first end face without interference from the fusible element, and wherein the second endcap flatly abuts the second end face without interference from the fusible element.

14. The method of claim 8, wherein a sidewall of the first endcap is parallel with a sidewall of the second endcap.

* * * * *